US011230789B2

(12) United States Patent
Seki et al.

(10) Patent No.: US 11,230,789 B2
(45) Date of Patent: Jan. 25, 2022

(54) METHOD OF REMOVING LIQUID FROM SEAL OF A SUBSTRATE HOLDER

(71) Applicant: EBARA CORPORATION, Tokyo (JP)

(72) Inventors: Masaya Seki, Tokyo (JP); Hideki Takayanagi, Tokyo (JP); Kiyoshi Suzuki, Tokyo (JP); Masayuki Satake, Tokyo (JP); Jumpei Fujikata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 133 days.

(21) Appl. No.: 16/685,038

(22) Filed: Nov. 15, 2019

(65) Prior Publication Data

US 2020/0199769 A1 Jun. 25, 2020

(30) Foreign Application Priority Data

Dec. 21, 2018 (JP) ..... JP2018-239893

(51) Int. Cl.
*C25D 7/12* (2006.01)
*C25D 17/00* (2006.01)
*C25D 21/12* (2006.01)

(52) U.S. Cl.
CPC ..... *C25D 17/004* (2013.01); *C25D 7/123* (2013.01); *C25D 21/12* (2013.01)

(58) Field of Classification Search
CPC ..... C25D 17/004
See application file for complete search history.

(56) References Cited

U.S. PATENT DOCUMENTS

2001/0010287 A1* 8/2001 Wang ..... C25F 7/00 204/297.01

FOREIGN PATENT DOCUMENTS

JP 2003-277995 A 10/2003

* cited by examiner

*Primary Examiner* — Ho-Sung Chung
(74) *Attorney, Agent, or Firm* — BakerHostetler

(57) ABSTRACT

A method capable of removing a liquid from a seal of a substrate holder so as to prevent contact between the liquid and an electrical contact of the substrate holder is provided. The method includes: immersing the substrate in a plating solution, with a seal and an electrical contact of the substrate holder in contact with the substrate; applying a voltage between the substrate and an anode in the presence of the plating solution to plate the substrate; pulling up the plated substrate from the plating solution; separating the seal from the plated substrate; and forming a flow of gas passing through a gap between the plated substrate and the seal, the flow of gas being directed from an inside to an outside of the substrate holder.

8 Claims, 10 Drawing Sheets

METHOD OF REMOVING LIQUID FROM SEAL OF A SUBSTRATE HOLDER

CROSS REFERENCE TO RELATED APPLICATION

This document claims priority to Japanese Patent Application Number 2018-239893 filed Dec. 21, 2018, the entire contents of which are hereby incorporated by reference.

BACKGROUND

An electroplating apparatus, which is an example of a plating apparatus, is configured to immerse a substrate (for example, a wafer) held by a substrate holder in a plating solution, and apply a voltage between the substrate and an anode to deposit a conductive film on a surface of the substrate. Since the substrate holder is immersed in the plating solution during plating of the substrate, it is necessary to prevent the plating solution from contacting electrical contacts which are in contact with a periphery of the substrate. Therefore, the substrate holder is provided with an endless seal that prevents the plating solution from entering an interior of the substrate holder. When the substrate holder is holding the substrate, the seal contacts the periphery of the substrate to prevent the plating solution from contacting the electrical contacts of the substrate holder.

When the plating of the substrate is completed, the substrate is taken out of the substrate holder and a new substrate is mounted on the substrate holder. The new substrate is then plated in the same manner. Such operations are repeated, so that a plurality of substrates are plated using the substrate holder.

However, as the substrate holder is repeatedly used to plate a plurality of substrates, the plating solution, attached to the seal of the substrate holder, gradually moves into the interior of the substrate holder, and eventually contacts the electrical contacts. The plating solution may cause corrosion of the electrical contacts, and as a result, a contact resistance between a substrate and the electrical contacts changes. Such a change in contact resistance may prevent uniform plating of a substrate.

SUMMARY OF THE INVENTION

According to an embodiment, there is provided a method which can remove a liquid from a seal of a substrate holder so as to prevent contact between the liquid and an electrical contact of the substrate holder.

Embodiments, which will be described below, relate to method of removing a liquid from a seal of a substrate holder for use in plating of a substrate, such as a wafer.

In an embodiment, there is provided a method of plating a substrate with use of a substrate holder, comprising: immersing the substrate in a plating solution, with a seal and an electrical contact of the substrate holder in contact with the substrate; applying a voltage between the substrate and an anode in the presence of the plating solution to plate the substrate; pulling up the plated substrate from the plating solution; separating the seal from the plated substrate; and forming a flow of gas passing through a gap between the plated substrate and the seal, the flow of gas being directed from an inside to an outside of the substrate holder.

In an embodiment, forming the flow of gas passing through the gap comprises forming the flow of gas passing through the gap while keeping the gap within a predetermined range.

In an embodiment, forming the flow of gas passing through the gap comprises forming the flow of gas passing through the gap while keeping the gap constant.

In an embodiment, separating the seal from the plated substrate comprises separating the seal from the plated substrate when an internal space of the substrate is filled with the gas having a pressure higher than an atmospheric pressure, the internal space being formed by the seal in contact with the plated substrate.

In an embodiment, there is provided a method of plating a substrate with use of a substrate holder, comprising: forming a flow of gas passing through a gap between the substrate to be plated and a seal of the substrate holder, the flow of gas being directed from an inside to an outside of the substrate holder; immersing the substrate in a plating solution, with the seal and an electrical contact of the substrate holder in contact with the substrate; and applying a voltage between the substrate and an anode in the presence of the plating solution to plate the substrate.

In an embodiment, forming the flow of gas passing through the gap comprises forming the flow of gas passing through the gap while keeping the gap within a predetermined range.

In an embodiment, forming the flow of gas passing through the gap comprises forming the flow of gas passing through the gap while keeping the gap constant.

In an embodiment, the method further comprises: bringing the seal into contact with the substrate to form an internal space in the substrate holder after the flow of gas through the gas is formed; filling the internal space with a gas having a pressure higher than an atmospheric pressure; and detecting that an amount of decrease in pressure of the gas in the internal space during a predetermined monitoring time is smaller than a predetermined threshold value.

According to the above-described embodiments, the flow of gas is formed in the gap between the seal and the substrate. This flow of gas can prevent a liquid, such as a plating solution, from entering the interior of the substrate holder. As a result, corrosion of an electrical contact of the substrate holder due to contact with the liquid is prevented.

DESCRIPTION OF EMBODIMENTS

Figure 1:
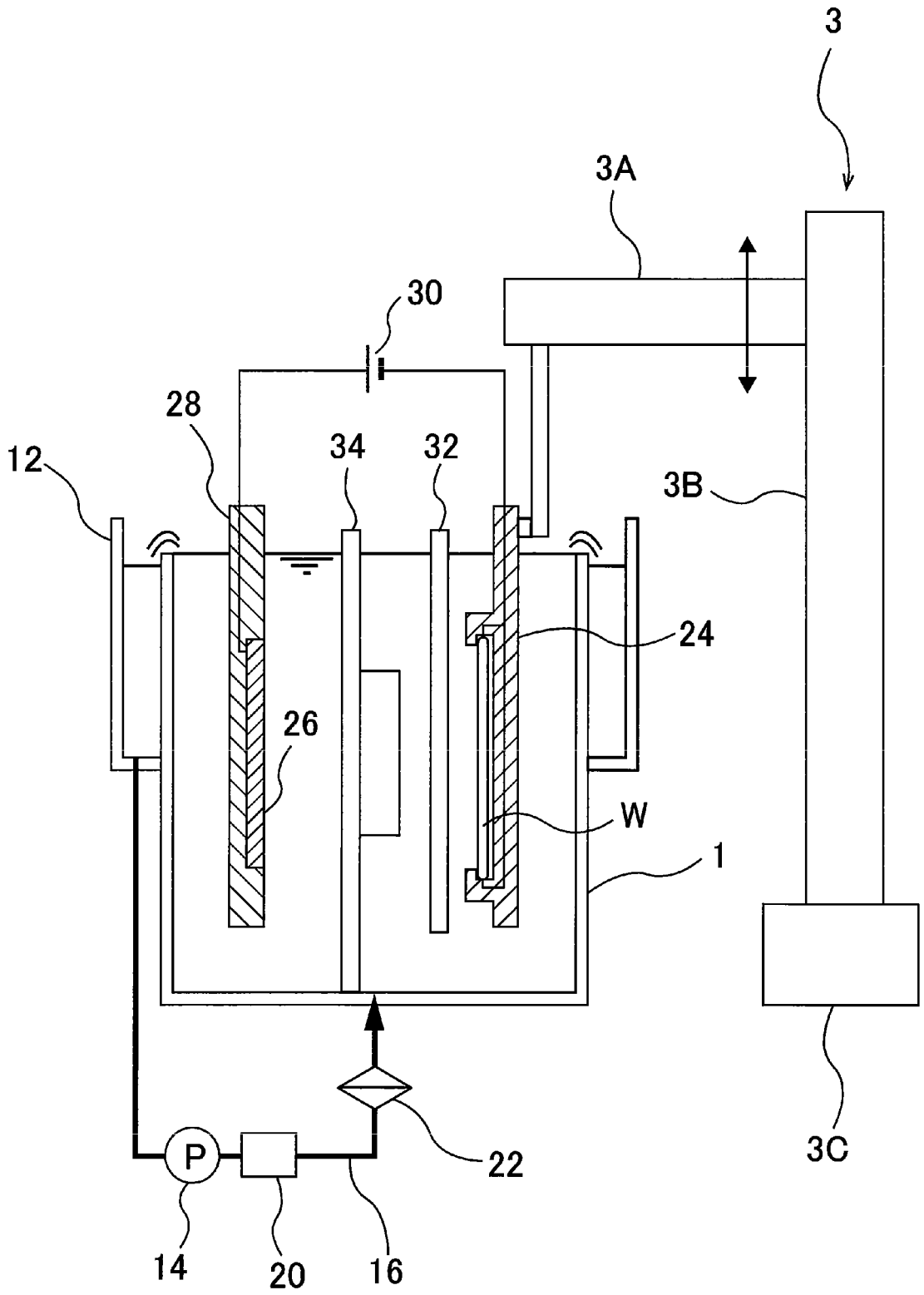
FIG. 1 is a vertical cross-sectional front view showing an embodiment of an electroplating apparatus which is an example of a plating apparatus.

Embodiments will now be described with reference to the drawings. FIG. 1 is a vertical cross-sectional front view showing an embodiment of an electroplating apparatus which is an example of a plating apparatus. As shown in FIG. 1, the electroplating apparatus includes a plating tank 1. A plating solution is held in the plating tank 1. An overflow tank 12 for receiving the plating solution that has overflowed a top edge of the plating tank 1 is provided adjacent to the plating tank 1.

One end of a plating-solution circulation line 16, which is provided with a pump 14, is coupled to a bottom of the overflow tank 12, while other end of the plating-solution circulation line 16 is coupled to a bottom of the plating tank 1. The plating solution that has accumulated in the overflow tank 12 is returned through the plating-solution circulation line 16 to the plating tank 1 by the actuation of the pump 14. A temperature control unit 20 for controlling the temperature of the plating solution, and a filter 22 for removing foreign matter from the plating solution, both located downstream of the pump 14, are attached to the plating-solution circulation line 16.

The electroplating apparatus further includes a substrate holder 24 for detachably holding a substrate W (an object to be plated), such as a wafer, and a transporting device 3 for immersing the substrate W, held on the substrate holder 24, in the plating solution held in the plating tank 1. The transporting device 3 includes a holding arm 3A for holding the substrate holder 24, a vertical movement device 3B for moving the substrate holder 24 up and down, and a horizontal movement device 3C for moving the substrate holder 24 in a horizontal direction. The holding arm 3A is coupled to the vertical movement device 3B, so that the substrate holder 24 and the holding arm 3A are moved up and down together by the vertical movement device 3B. The vertical movement device 3B is coupled to the horizontal movement device 3C, so that the substrate holder 24, the holding arm 3A, and the vertical movement device 3B are moved together in the horizontal direction by the horizontal movement device 3C. Each of the vertical movement device 3B and the horizontal movement device 3C has a known actuator, such as a linear motor.

The substrate holder 24, held by the holding arm 3A, is moved to a position above the plating tank 1 by the horizontal movement device 3C of the transporting device 3. Then, as shown in FIG. 1, the substrate holder 24 is lowered by the vertical movement device 3B of the transporting device 3, while the substrate holder 24 is still held by the holding a in 3A. The substrate W held by the substrate holder 24 is immersed in the plating solution in the plating tank 1. When the plating of the substrate W is completed, the substrate holder 24 is raised by the vertical movement device 3B, until the substrate W held by the substrate holder 24 is pulled up from the plating solution. In the present embodiment, the substrate holder 24 is disposed in a vertical posture in the plating tank 1, while in one embodiment, the substrate holder 24 may be disposed in a horizontal posture or an oblique posture in the plating tank 1.

The electroplating apparatus further includes an anode 26 disposed in the plating tank 1, an anode holder 28 holding the anode 26, and a plating power source 30. When the substrate holder 24, holding the substrate W, is set in the plating tank 1, the substrate W and the anode 26 face each other in the plating tank 1. A conductive layer (for example, a seed layer) is formed in advance on the surface (surface to be plated) of the substrate W. The anode 26 is electrically coupled to a positive pole of the plating power source 30, and the conductive layer of the substrate W is electrically coupled via the substrate holder 24 to a negative pole of the plating power source 30. When the plating power source 30 applies a voltage between the anode 26 and the substrate W, plating of the substrate W progresses in the presence of the plating solution, thus depositing a metal (e.g. copper) on the surface of the substrate W.

A paddle 32, which is configured to reciprocate parallel to the surface of the substrate W to agitate the plating solution, is disposed between the substrate holder 24 and the anode 26. By agitating the plating solution with the paddle 32, a sufficient amount of metal ions can be supplied uniformly to the surface of the substrate W. Further, a regulation plate 34 made of a dielectric material is disposed between the paddle 32 and the anode 26 for making distribution of electric potential more uniform over the entire surface of the substrate W.

Figure 2:
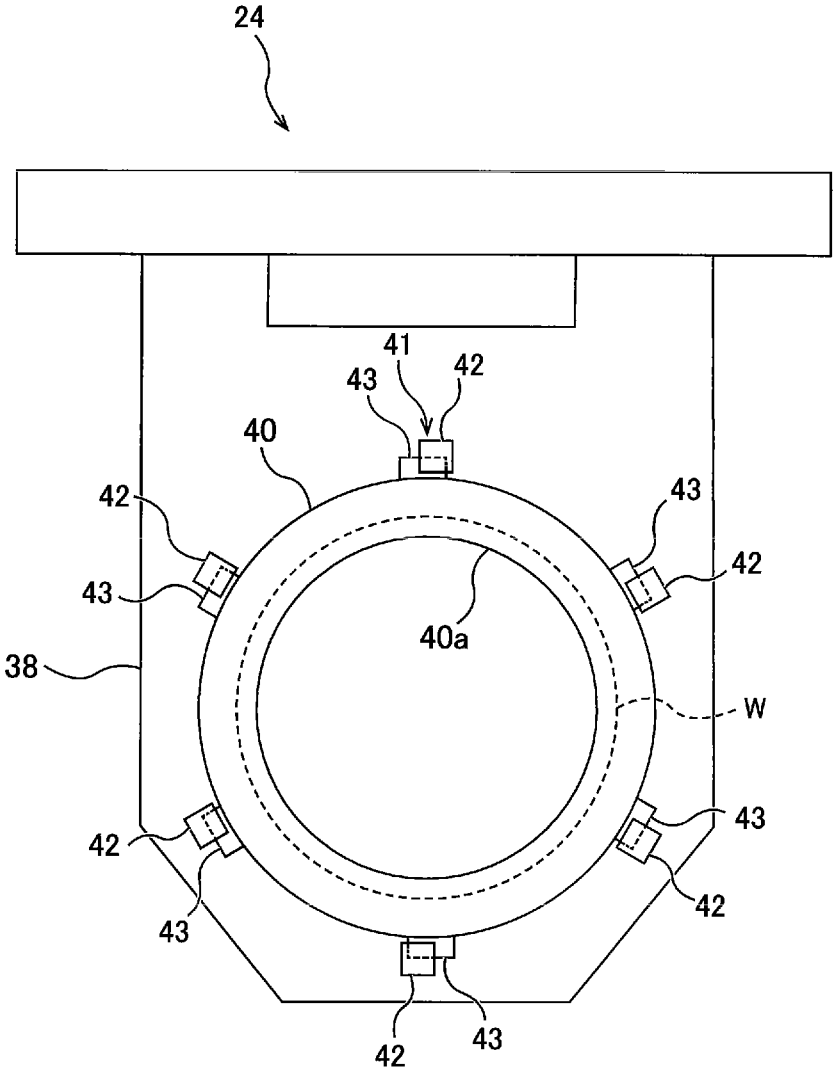
FIG. 2 is a schematic front view showing a substrate holder.
Figure 3:
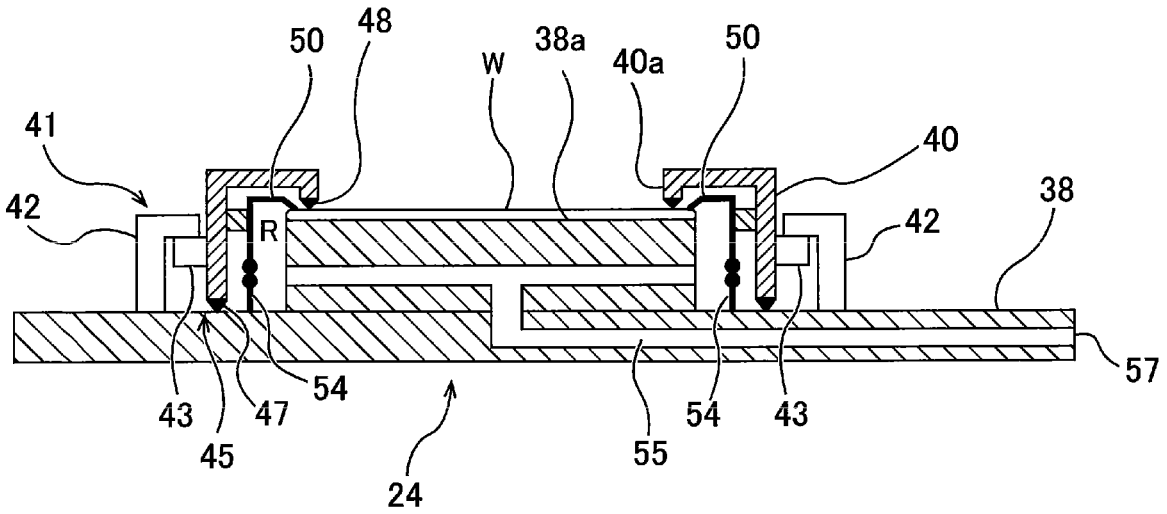
FIG. 3 is a schematic cross-sectional view showing the substrate holder.

FIG. 2 is a schematic front view showing the substrate holder 24, and FIG. 3 is a schematic cross-sectional view showing the substrate holder 24. The substrate holder 24 is configured to be used in the electroplating apparatus for electroplating the substrate W, such as a wafer. The substrate holder 24 includes a first holding member 38 and a second holding member 40 for holding the substrate W. The second holding member 40 is secured to the first holding member 38 by a coupling mechanism 41.

Figure 4:
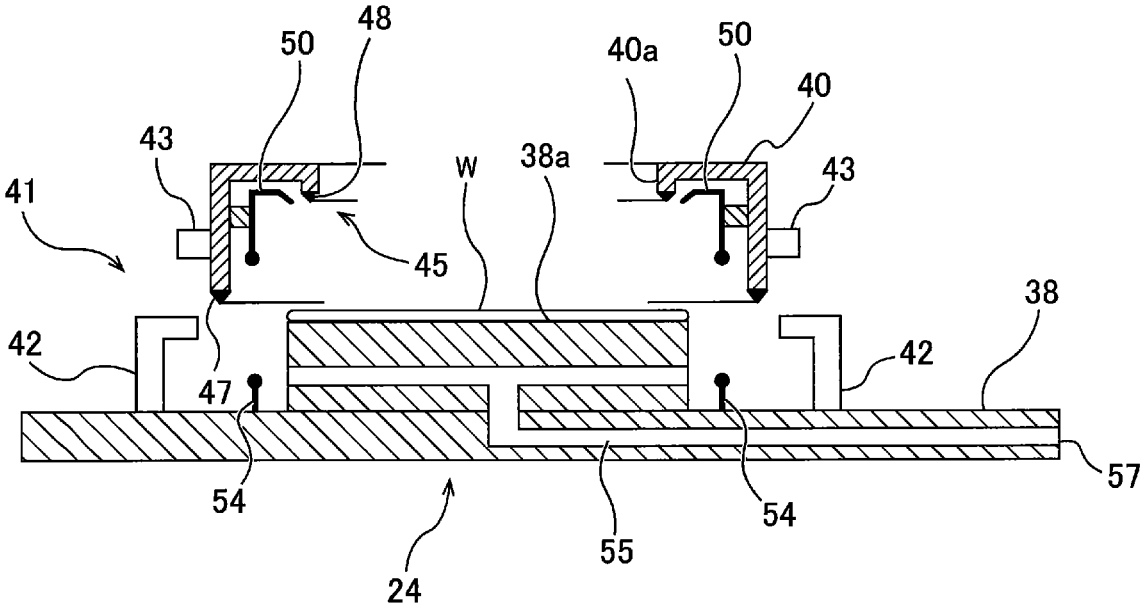
FIG. 4 is a schematic cross-sectional view showing the substrate holder in an open state.

The coupling mechanism 41 includes a plurality of first coupling members 42 secured to the first holding member 38, and a plurality of second coupling members 43 secured to the second holding member 40. The second coupling members 43 are mounted to an outer surface of the second holding member 40. The first coupling members 42 and the second coupling members 43 are configured to be engageable with each other. When the first coupling members 42 and the second coupling members 43 engage with each other, the second holding member 40 is secured to the first holding member 38 (i.e., the substrate holder 24 is closed). The second holding member 40 can be detached from the first holding member 38 (i.e., the substrate holder 24 can open) by disengaging the first coupling members 42 and the second coupling members 43. FIG. 4 is a schematic cross-sectional view showing the substrate holder 24 in an open state.

The first holding member 38 has a substrate support surface 38*a* for supporting a back surface of the substrate W. The substrate W is placed on the substrate support surface 38*a*. The second holding member 40 has an opening 40*a* which is smaller than a front surface of the substrate W. In this embodiment, the opening 40*a* has a circular shape, and a diameter of the opening 40*a* is smaller than the diameter of the substrate W. When the substrate W is held by the substrate holder 24, the front surface of the substrate W is exposed through the opening 40*a*. The front surface of the substrate W is a surface to be plated.

The substrate holder 24 includes a seal 45. Specifically, the second holding member 40 of the substrate holder 24 has an endless first seal 48 and an endless second seal 47. The seal 45 includes the first seal 48 and the second seal 47. The first seal 48 and the second seal 47 may be seal members, such as O-rings. In one embodiment, the second holding member 40 itself, including the first seal 48 and the second seal 47, may be formed of a material having a sealing function. The first seal 48 and the second seal 47 may be integral with the second holding member 40. In this embodiment, the first seal 48 and the second seal 47 each have an annular shape and are arranged concentrically. The second seal 47 is located radially outwardly of the first seal 48. The size (diameter) of the second seal 47 is larger than the size (diameter) of the first seal 48. In a case of a face-down type plating apparatus in which a substrate holder, holding a substrate with its to-be-plated surface facing downward, is disposed horizontally in a plating tank, the second seal 47 may be omitted.

When the second holding member 40 is secured to the first holding member 38 by the coupling mechanism 41 with the back surface of the substrate W supported on the substrate support surface 38*a*, the first seal 48 is pressed against a peripheral portion of the front surface (to-be-plated surface) of the substrate W, and the second seal 47 is pressed against the first holding member 38. The first seal 48 seals a gap between the second holding member 40 and the front surface of the substrate W, and the second seal 47 seals a gap between the first holding member 38 and the second holding member 40. Consequently, an internal space R is formed in the substrate holder 24.

The internal space R is formed by the seal 45. Specifically, the internal space R is formed by the first holding member 38, the second holding member 40, the first seal 48, the second seal 47, and the substrate W. The substrate holder 24 has a plurality of first electrical contacts 54 and a plurality of second electrical contacts 50 located in the internal space R. The first electrical contacts 54 are fixed to the first holding member 38, and the second electrical contacts 50 are fixed to the second holding member 40. When the substrate W is held by the substrate holder 24, one ends of the second electrical contacts 50 are brought into contact with the peripheral portion of the substrate W. When the substrate holder 24 is the closed state, the other ends of the second electrical contacts 50 are in contact with one ends of the first electrical contacts 54. The other ends of the plurality of first electrical contacts 54 are respectively coupled to a plurality of electric wires (not shown) extending in the first holding member 38. When the substrate holder 24 is set in the plating tank 1 shown in FIG. 1, the first electrical contacts 54 are electrically coupled to the plating power source 30 shown in FIG. 1 via the aforementioned electric wires.

Figure 5:
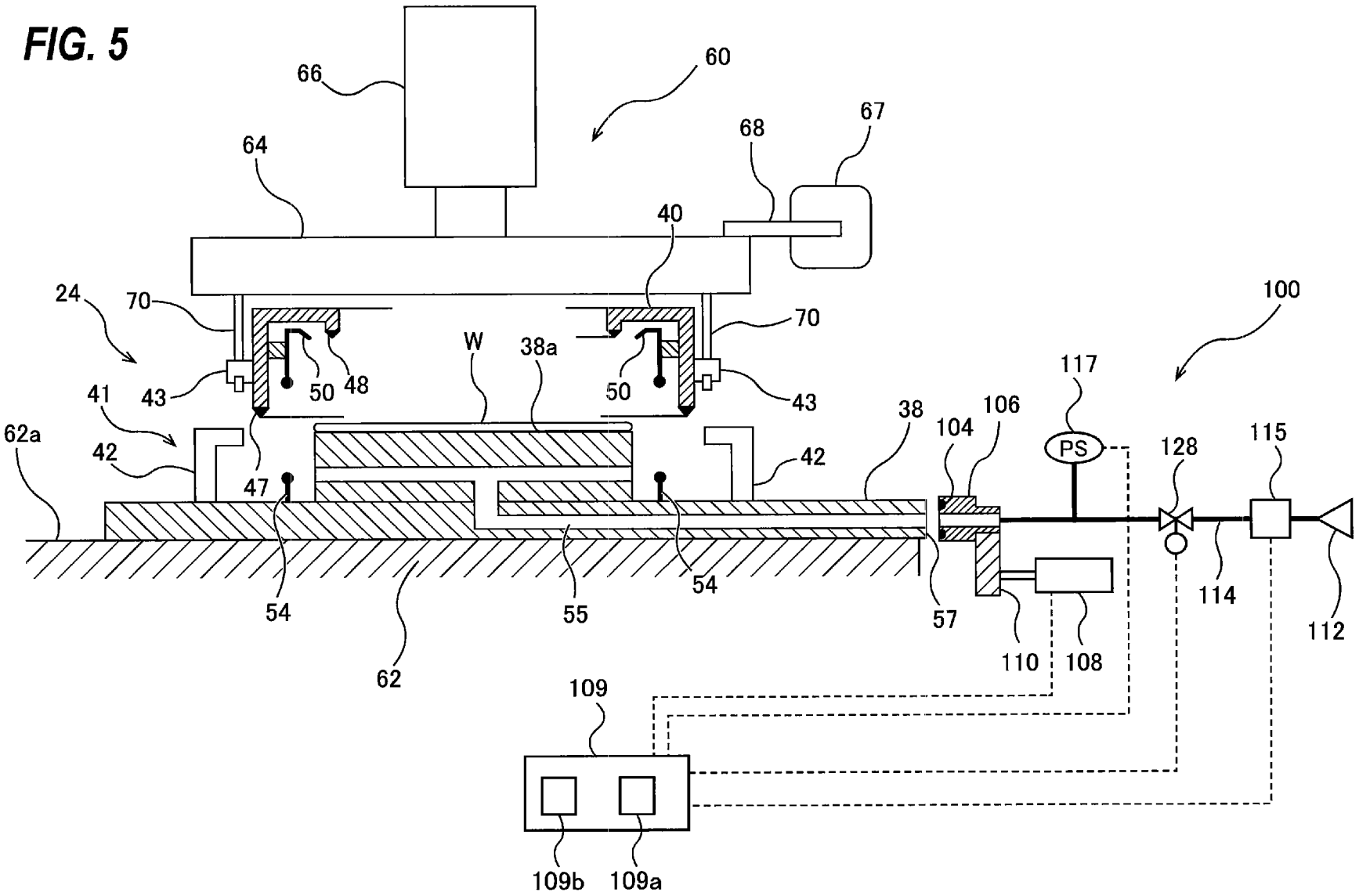
FIG. 5 is a view showing a state in which a fixing device opens the substrate holder.
Figure 6:
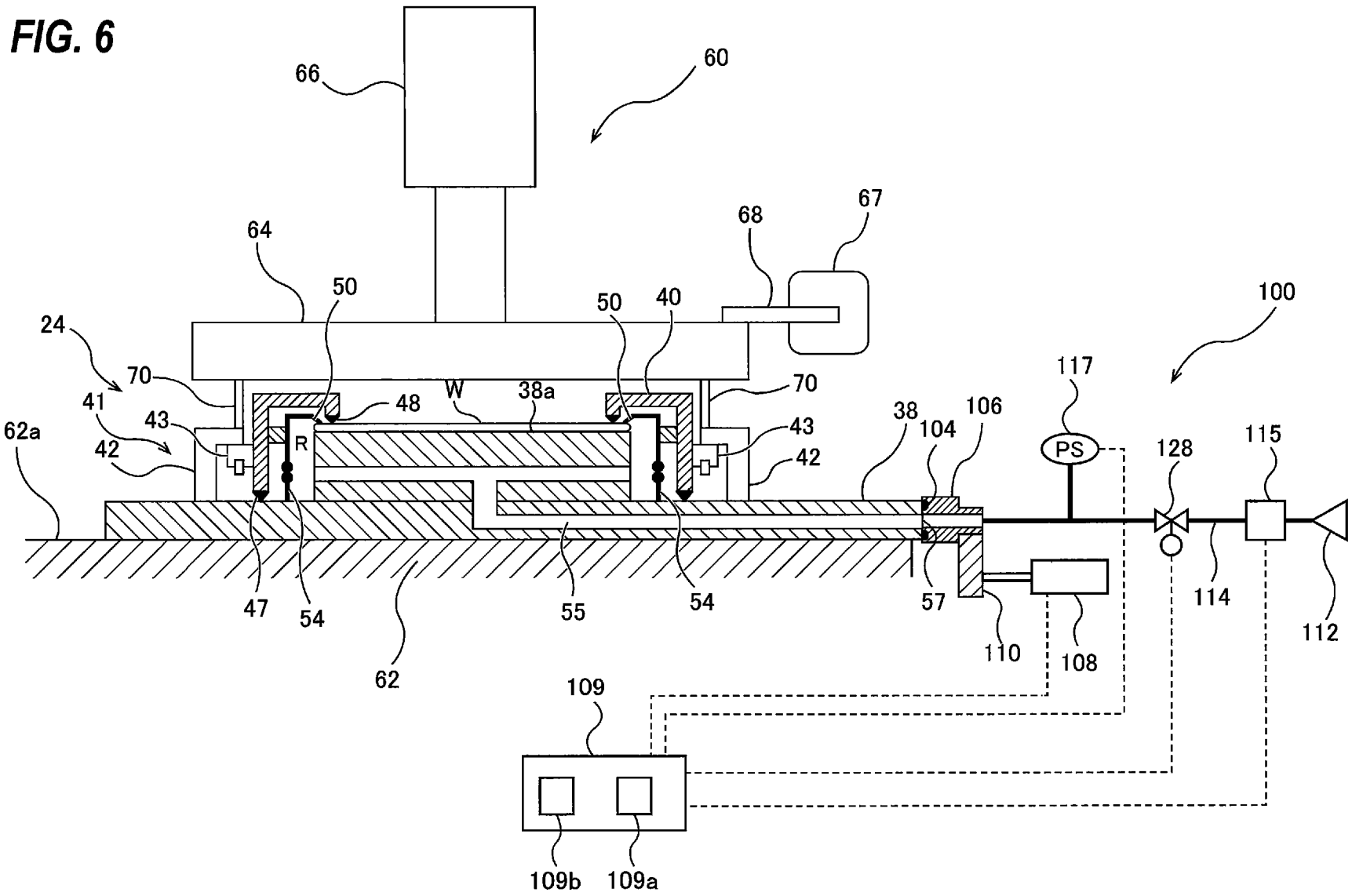
FIG. 6 is a view showing a state in which the fixing device closes the substrate holder.

The electroplating apparatus includes a fixing device 60 shown in FIGS. 5 and 6. Opening and closing the substrate holder 24, i.e., fixing the second holding member 40 to the first holding member 38, and separating the second holding member 40 from the first holding member 38 are performed by the fixing device 60 shown in FIGS. 5 and 6. FIG. 5 is a view showing a state in which the fixing device 60 separates the second holding member 40 from the first holding member 38, and FIG. 6 is a view showing a state in which the fixing device 60 fixes the second holding member 40 to the first holding member 38.

The substrate holder 24 is moved between the plating tank 1 and the fixing device 60 by the transporting device 3 shown in FIG. 1. As shown in FIGS. 5 and 6, the fixing device 60 includes a table 62 having a horizontal surface 62*a* on which the substrate holder 24 is placed, a holding head 64 for holding the second holding member 40 of the substrate holder 24 on the table 62, a head actuator 66 for moving the holding head 64 toward the first holding member 38 and away from the first holding member 38, and a rotary actuator 67 for rotating the holding head 64 about its axis. The rotary actuator 67 is coupled to the holding head 64 by a connecting shaft 68.

The substrate holder 24 is placed on the horizontal surface 62*a* of the table 62 with the first holding member 38 facing upward. The holding head 64 has a plurality of hooks 70. These hooks 70 have shapes that can engage with the plurality of second connecting members 43 fixed to the second holding member 40.

Operations of removing the substrate W from the substrate holder 24 are as follows. The head actuator 66 lowers the holding head 64, and then the rotary actuator 67 rotates the holding head 64 until the lower ends of the hooks 70 are located below the second connecting members 43. Next, the head actuator 66 causes the hooks 70 to engage with the second connection members 43 by slightly raising the holding head 64. When the rotary actuator 67 rotates the holding head 64 and the second holding member 40 with the hooks 70 in engagement with the second connection members 43, the engagement between the first connection members 42 and the second connection members 43 is released. The head actuator 66 elevates the holding head 64 together with the second holding member 40, so that the second holding member 40 is separated from the first holding member 38. When the second holding member 40 separates from the first holding member 38, the first seal 48 separates from the substrate W, the second electrical contacts 50 separate from the substrate W and the first electrical contacts 54, and the second seal 47 separates from the first holding member 38. The substrate W is then removed from the first holding member 38 by a transfer robot (not shown).

Operations of attaching the substrate W to the substrate holder 24 are as follows. When the second holding member 40 held by the holding head 64 is separated from the first holding member 38, the substrate W is placed on the substrate support surface 38*a* of the first holding member 38 by a transfer robot (not shown). The head actuator 66 lowers the holding head 64 together with the second holding member 40. Further, the rotary actuator 67 rotates the holding head 64 until the second connecting members 43 engage with the first connecting members 42. As a result, the second holding member 40 is fixed to the first holding member 38. At this time, the first seal 48 contacts the substrate W, the second electrical contacts 50 contact both the substrate W and the first electrical contacts 54, and the second seal 47 contacts the first holding member 38. Thereafter, the holding head 64 is elevated by the head actuator 66.

The head actuator 66 includes a combination of a ball screw mechanism and a servomotor (not shown). Similarly, the rotary actuator 67 also includes a combination of a ball screw mechanism and a servomotor (not shown). The head actuator 66 and the rotary actuator 67 are electrically coupled to an operation controller 109. The operations of the head actuator 66 and the rotary actuator 67 are controlled by the operation controller 109.

The operation controller 109 is constituted by at least one computer. The operation controller 109 includes a memory 109*a* and an arithmetic device 109*b* therein. The arithmetic device 109*b* includes CPU (central processing unit) or GPU (graphic processing unit) for performing arithmetic operation according to instructions contained in a program stored in the memory 109*a*. The memory 109*a* includes a main memory (for example, random-access memory) which is accessible by the arithmetic device 109*b*, and an auxiliary memory (for example, a hard disk drive or solid-state drive) that stores data and the program therein.

As shown in FIG. 6, an internal passage 55 is formed in the first holding member 38. The first holding member 38 has a gas introduction port 57 formed in the outer surface of the first holding member 38. The gas introduction port 57 opens to the outside of the first holding member 38. One end of the internal passage 55 communicates with the gas introduction port 57, and the other end communicates with the internal space R. The internal space R is in communication with the gas introduction port 57 through the internal passage 55.

The electroplating apparatus further includes a liquid removing apparatus 100 for removing a liquid from the first seal 48 and the second seal 47 of the substrate holder 24. The liquid removing apparatus 100 includes a gas supply line 114 extending from a pressurized-gas supply source 112, a pressure regulating valve 115 for controlling a pressure of a gas in the gas supply line 114, a pressure measuring device 117 for measuring the pressure of the gas in the gas supply line 114, and an on-off valve 128 attached to the gas supply line 114. The on-off valve 128, the pressure regulating valve 115, and the pressure measuring device 117 are coupled to the gas supply line 114. Examples of the pressurized-gas supply source 112 include compressed-air supply source and inert-gas supply source.

One end of the gas supply line 114 is coupled to the pressurized-gas supply source 112, and the other end is coupled to a flow path joint 106 having a seal ring 104. The flow path joint 106 is coupled to an actuator 108, such as an air cylinder, via a connection plate 110. As shown in FIG. 6, the actuator 108 can press the seal ring 104 of the flow path joint 106 against the gas introduction port 57 of the substrate holder 24 to couple the flow path joint 106 to the substrate holder 24. When the flow path joint 106 is coupled to the substrate holder 24, the gas supply line 114 communicates with the internal space R through the flow path joint 106, the gas introduction port 57, and the internal passage 55. The actuator 108 operates in accordance with instructions from the operation controller 109.

The pressure measuring device 117 is located between a substrate-holder-side end of the gas supply line 114 and the on-off valve 128. The pressure measuring device 117, the on-off valve 128, and the pressure regulating valve 115 are arranged in series along the gas supply line 114 in the order of the pressure measuring device 117, the on-off valve 128, and the pressure regulating valve 115 from the substrate-holder-side end.

The pressure measuring device 117, the on-off valve 128, and the pressure regulating valve 115 are electrically coupled to the operation controller 109. The operation controller 109 is configured to open and close the on-off valve 128, so that the operations of the on-off valve 128 are controlled by the operation controller 109.

The operation controller 109 is configured to transmit a predetermined set pressure value to the pressure regulating valve 115. The pressure regulating valve 115 is configured to control the pressure of the gas in the gas supply line 114 according to the set pressure value. An example of such pressure regulating valve 115 may be an electropneumatic regulator. The pressure measuring device 117 is configured to transmit a measurement value of the pressure of the gas in the gas supply line 114 to the operation controller 109.

Figure 7:
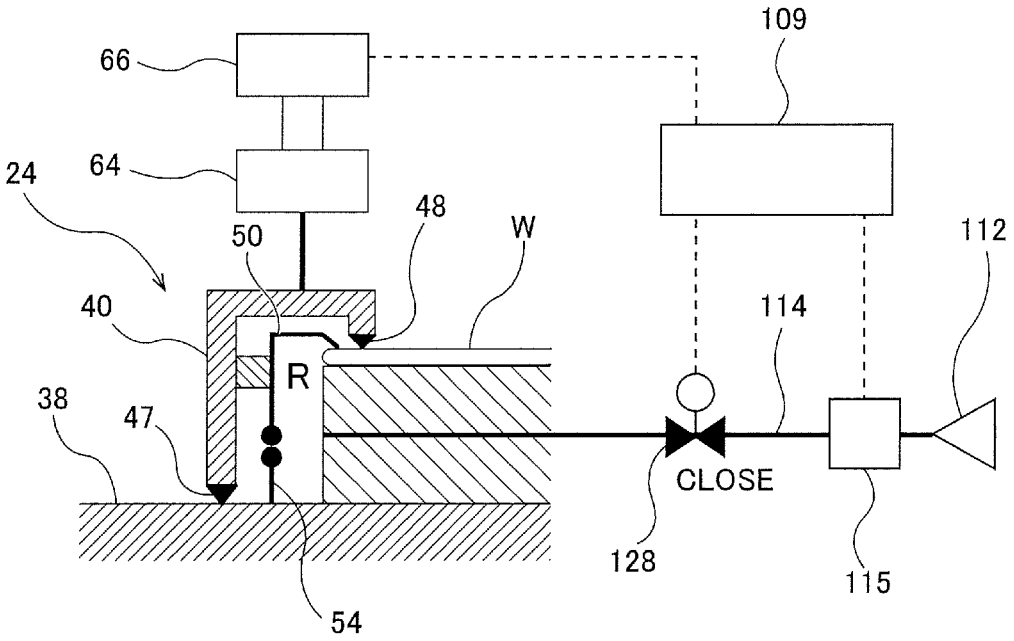
FIG. 7 is a schematic view for explaining operations of a liquid removing apparatus.
Figure 8:
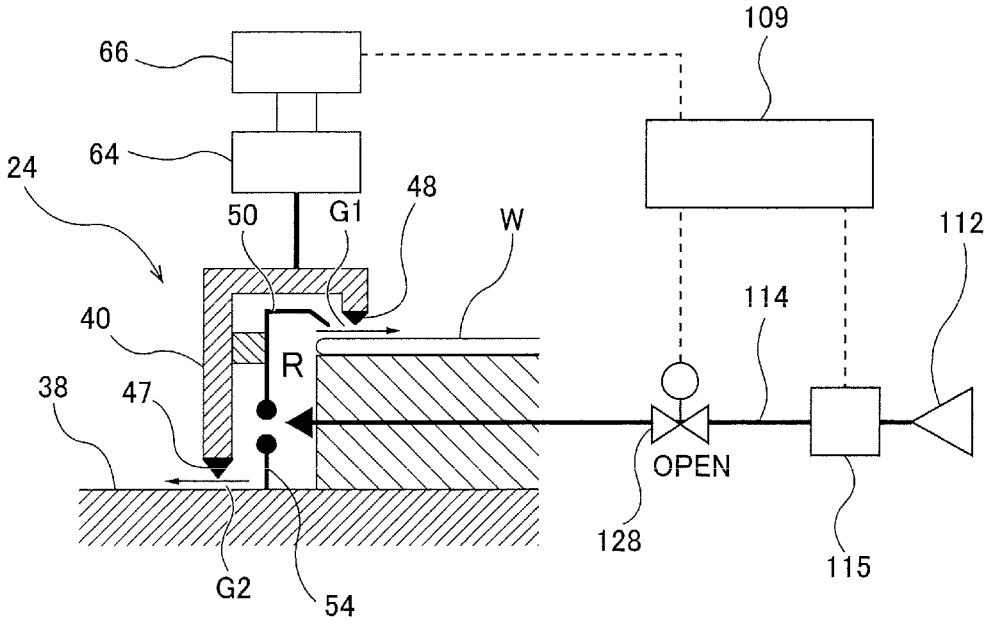
FIG. 8 is a schematic view for explaining the operations of the liquid removing apparatus.

FIGS. 7 and 8 are schematic views for explaining the operations of the liquid removing apparatus 100. In FIGS. 7 and 8, in particular, the holding head 64 and the head actuator 66 are schematically depicted. The liquid removing apparatus 100 is provided to remove a liquid (for example, the plating solution) on the first seal 48 and the second seal 47 and to prevent the liquid from contacting the electrical contacts 50, 54.

As shown in FIG. 7, with the on-off valve 128 closed, the operation controller 109 transmits a predetermined set pressure value, which is higher than an atmospheric pressure, to the pressure regulating valve 115. The pressure regulating valve 115 operates such that the pressure of the gas in the gas supply line 114 is maintained at the set pressure value.

As shown in FIG. 8, the operation controller 109 instructs the head actuator 66 to elevate the holding head 64, holding the second holding member 40, to separate the second holding member 40 from the first holding member 38. At this time, the first seal 48 and the second electrical contacts 50 are separated from the substrate W, and the second seal 47 is separated from the first holding member 38. A gap G1 is formed between the first seal 48 and the substrate W, and a gap G2 is formed between the second seal 47 and the first holding member 38.

Next, the operation controller 109 opens the on-off valve 128. The gas, such as air or an inert gas (e.g., nitrogen gas), is injected into the internal space R of the substrate holder 24 through the gas supply line 114. The gas flows from the inside to the outside of the substrate holder 24 through the gap G1 between the first seal 48 and the substrate W. This flow of the gas blows the liquid on the first seal 48 out of the substrate holder 24, thereby removing the liquid from the first seal 48. Similarly, the gas flows from the inside to the outside of the substrate holder 24 through the gap G2 between the second seal 47 and the first holding member 38. This flow of the gas blows the liquid on the second seal 47 out of the substrate holder 24, thereby removing the liquid from the second seal 47.

In the present embodiment, the operation controller 109 is configured to keep the on-off valve 128 open so as to continue the formation of the flows of the gas in the gap G1 between the first seal 48 and the substrate W and in the gap G2 between the second seal 47 and the first holding member 38, as long as the gaps G1, G2 are not more than a set value. The set value of the gaps G1, G2 are such that the velocity of the gas flowing through the gaps G1, G2 is high enough to remove the liquid from the first seal 48 and the second seal 47. In the present embodiment, a flow rate of the gas flowing through the gaps G1, G2 is constant. In one embodiment, the flow rate of the gas flowing through the gaps G1, G2 may vary.

The flows of the gas formed in the gaps G1, G2 can prevent the liquid, such as the plating solution, from entering the inside of the substrate holder 24. In particular, the flows of gas can prevent the liquid from coming into contact with the electrical contacts 50, 54, thereby preventing corrosion of the electrical contacts 50, 54 and thus achieving long life of the electrical contacts 50, 54.

In the present embodiment, in order to ensure the removal of the liquid from the first seal 48 and the second seal 47, the operation controller 109 instructs the head actuator 66 to keep the gaps G1, G2 constant for a predetermined time, while keeping the on-off valve 128 open to allow for the formation of the flows of the gas through the gaps G1, G2. While the gaps G1, G2 are kept constant, the gas continues to flow through the gaps G1, G2. The magnitude of the gaps G1, G2 is such that the velocity of the gas flowing through the gaps G1, G2 is high enough to remove the liquid from the first seal 48 and the second seal 47. In one example, the gaps G1, G2 are maintained at a magnitude selected from a range of 0.5 mm to 1.0 mm. The operation controller 109 can determine a current magnitude of the gaps G1, G2 from an amount of manipulation for the head actuator 66.

In one embodiment, the operation controller 109 may instruct the head actuator 66 to maintain the gaps G1, G2 within a predetermined range for the predetermined time while maintaining the on-off valve 128 open to form the flows of gas through the gaps G1, G2. In one example, the predetermined range is in a range of 0.5 mm to 1.0 mm.

In the present embodiment, the supply of gas into the internal space R of the substrate holder 24 is started after the gaps G1, G2 are formed. In one embodiment, the supply of gas into the internal space R of the substrate holder 24 may be started before the gaps G1, G2 are formed. Specifically, the operation controller 109 may open the on-off valve 128 to allow for the supply of the gas into the internal space R before the first seal 48 and the second seal 47 are separated from the substrate W and the first holding member 38. The gas present in the internal space R has a pressure higher than the atmospheric pressure. Therefore, at the same time when the first seal 48 separates from the substrate W, the gas flows from the inside to the outside of the substrate holder 24 through the gap G1 between the first seal 48 and the substrate W. Similarly, at the same time when the second seal 47 separates from the first holding member 38, the gas flows from the inside to the outside of the substrate holder 24 through the gap G2 between the second seal 47 and the first holding member 38. Such operation of filling the internal space R with the gas at a pressure higher than the atmospheric pressure before the first seal 48 and the second seal 47 are separated from the substrate W and the first holding member 38 can reliably prevent the liquid from entering the interior of the substrate holder 24.

Figure 9:
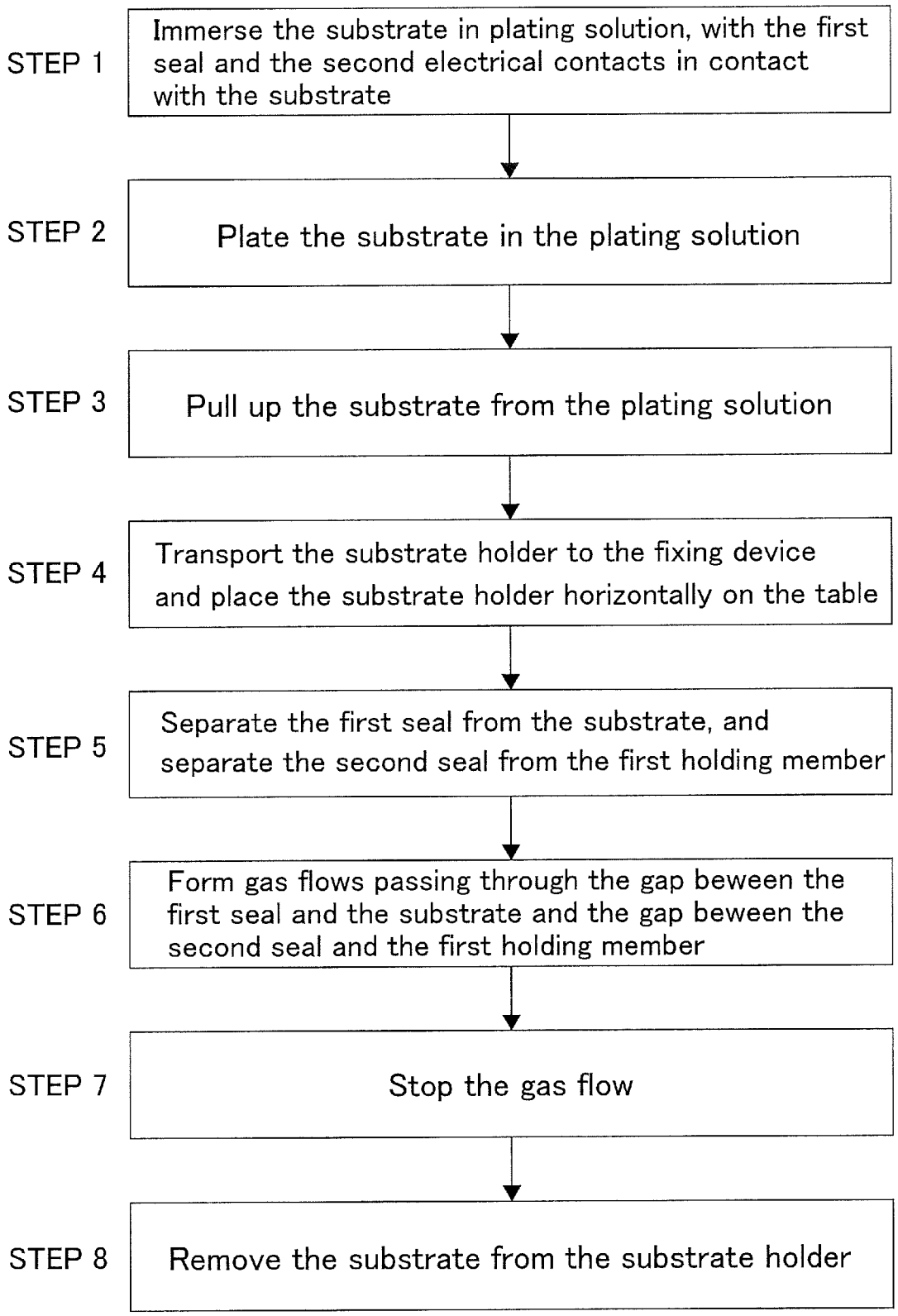
FIG. 9 is a flowchart illustrating one embodiment of a process of removing a liquid from a first seal and a second seal using a liquid removing apparatus after plating of a substrate.

FIG. 9 is a flowchart illustrating an embodiment of a process for removing the liquid from the first seal 48 and the second seal 47 using the liquid removing apparatus 100 after the substrate W is plated.

In step 1, the substrate W is immersed in the plating solution held in the plating tank 1, with the first seal 48 and the second electrical contacts 50 of the substrate holder 24 in contact with the substrate W (see FIGS. 1 and 3). The second seal 47 of the substrate holder 24 is also in contact with the first holding member 38.

In step 2, a voltage is applied between the substrate W and the anode 26 in the presence of the plating solution to plate the substrate W.

In step 3, the plated substrate W is pulled up from the plating solution by the transporting device 3.

In step 4, the substrate holder 24 holding the substrate W is transported by the transporting device 3 to the fixing device 60, and is placed horizontally on the table 62 of the fixing device 60 (see FIG. 6).

In step 5, the first seal 48 and the second electrical contacts 50 are separated from the plated substrate W, and at the same time, the second seal 47 is separated from the first holding member 38.

In step 6, the operation controller 109 opens the on-off valve 128 to allow for formation of the flows of gas from the inside to the outside of the substrate holder 24 through the gap G1 between the plated substrate W and the first seal 48 and through the gap G2 between the second seal 47 and the first holding member 38, thereby removing the liquid from the first seal 48 and the second seal 47 (see FIG. 8). In one embodiment, the flows of gas through the gaps G1, G2 are formed, while the gaps G1, G2 are kept constant or the gaps G1, G2 are kept within the predetermined range.

In step 7, the operation controller 109 instructs the on-off valve 128 to close to thereby stop the flows of gas through the gaps G1, G2.

In step 8, the substrate W is removed from the substrate holder 24 by the transfer robot (not shown).

Figure 10:
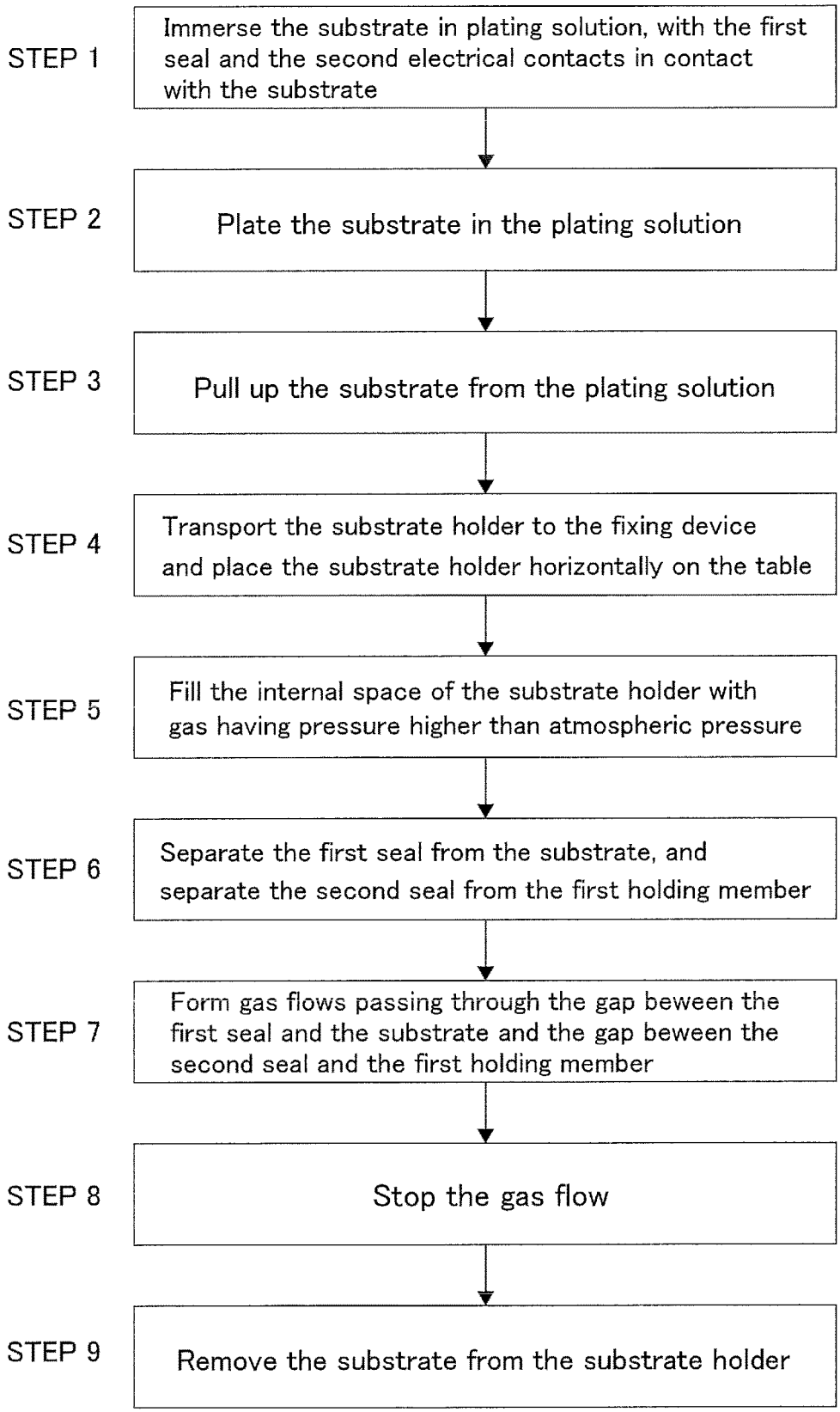
FIG. 10 is a flowchart illustrating another embodiment of a process of removing a liquid from the first seal and the second seal using the liquid removing apparatus after plating of a substrate.

FIG. 10 is a flowchart for explaining another embodiment of a process of removing the liquid from the first seal 48 and the second seal 47 using the liquid removing apparatus 100 after the substrate W is plated.

Step 1 to step 4 are the same as the step 1 to the step 4 shown in FIG. 9, and therefore repetitive descriptions will be omitted.

In step 5, the operation controller 109 opens the on-off valve 128, injects the gas into the internal space R of the substrate holder 24, and fills the internal space R with the gas whose pressure is higher than the atmospheric pressure.

In step 6, the first seal 48 is separated from the plated substrate W, and at the same time, the second seal 47 is separated from the first holding member 38. At this time, the flows of gas directed from the inside to the outside of the substrate holder 24 through the gap G1 between the plated substrate W and the first seal 48 and through the gap G2 between the second seal 47 and the first holding member 38 are formed (see FIG. 8).

In step 7, the flows of gas through the gaps G1, G2 are continuously formed, so that the liquid is removed from the first seal 48 and the second seal 47. In one embodiment, the flows of gas through the gaps G1, G2 are formed, while the gaps G1, G2 are kept constant or the gaps G1, G2 are kept within the predetermined range.

In step 8, the operation controller 109 instructs the on-off valve 128 to close to thereby stop the flows of gas through the gaps G1, G2.

In step 9, the substrate W is removed from the substrate holder 24 by the transfer robot (not shown).

In one embodiment, a liquid may be removed from the first seal 48 and the second seal 47 prior to plating of the substrate W.

Figure 11:
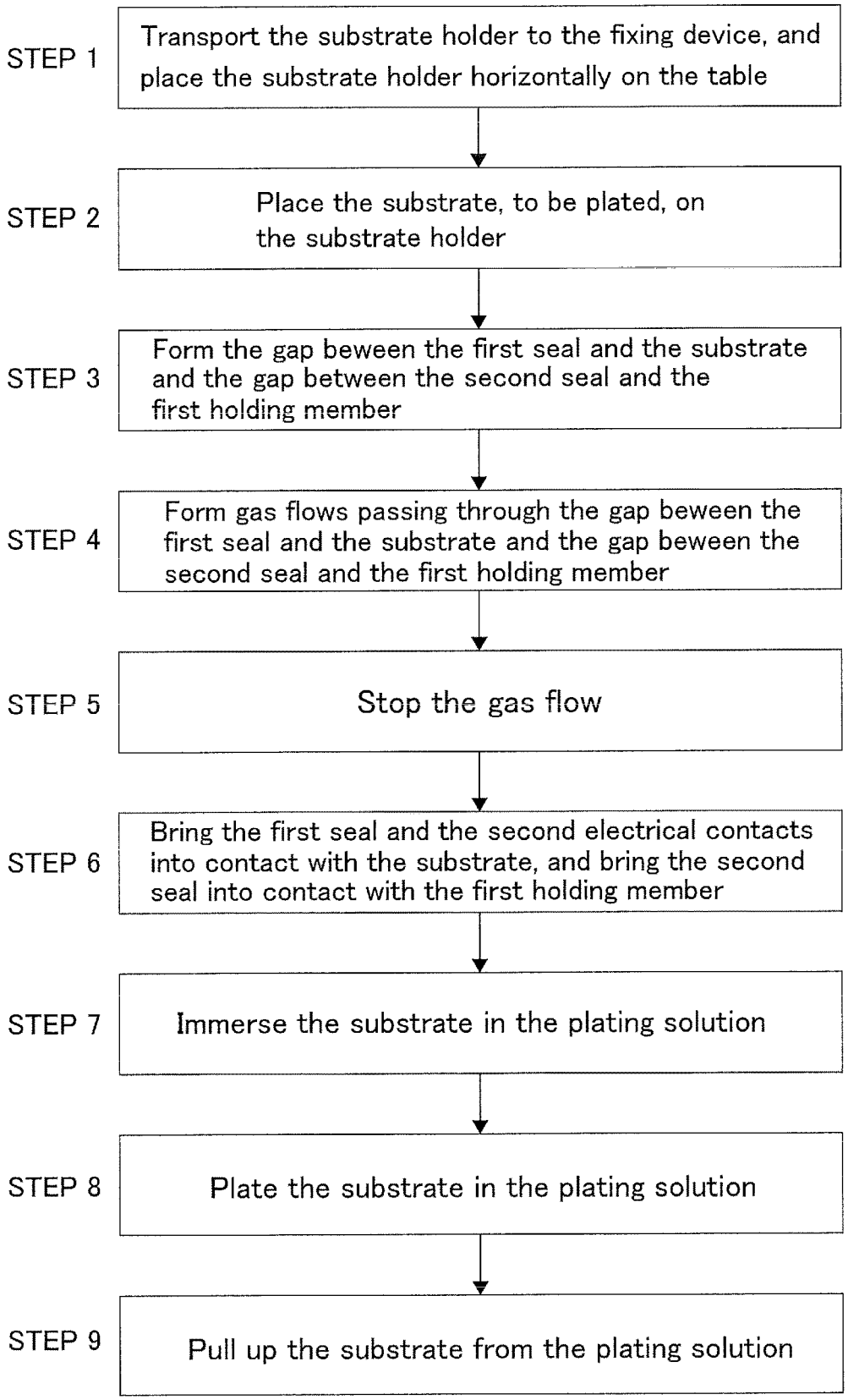
FIG. 11 is a flowchart describing one embodiment of a process for removing a liquid from the first seal and the second seal using the liquid removing apparatus prior to plating of a substrate.

FIG. 11 is a flowchart illustrating one embodiment of a process for removing the liquid from the first seal 48 and the second seal 47 using the liquid removing apparatus 100 prior to plating of the substrate W.

In step 1, the substrate holder 24 is transported by the transporting device 3 to the fixing device 60, and is placed horizontally on the table 62 of the fixing device 60.

In step 2, the substrate W to be plated is placed on the substrate support surface 38*a* of the first holding member 38 of the substrate holder 24 by a transfer robot (not shown).

In step 3, the operation controller 109 instructs the head actuator 66 to lower the second holding member 40 to form the gap G1 between the first seal 48 and the substrate W and the gap G2 between the second seal 47 and the first holding member 38 as well.

In step 4, the operation controller 109 opens the on-off valve 128 to allow for the formation of the flows of gas from the inside to the outside of the substrate holder 24 through the gap G1 between the substrate W and the first seal 48 and through the gap G2 between the second seal 47 and the first holding member 38, thereby removing the liquid from the first seal 48 and the second seal 47 (see FIG. 8). In one embodiment, the flows of gas through the gaps G1, G2 are formed, while the gaps G1, G2 are kept constant or the gaps G1, G2 are kept within the predetermined range.

In step 5, the operation controller 109 instructs the on-off valve 128 to close to thereby stop the flows of gas through the gaps G1, G2.

In step 6, the first seal 48 and the second electrical contacts 50 of the substrate holder 24 are brought into contact with the substrate W, and the second seal 47 is brought into contact with the first holding member 38 (see FIG. 7).

In step 7, the substrate holder 24, holding the substrate W to be plated, is transported by the transporting device 3 to the plating tank 1, and the substrate W is immersed in the plating solution.

In step 8, a voltage is applied between the substrate W and the anode 26 in the presence of the plating solution to plate the substrate W.

In step 9, the plated substrate W is pulled up from the plating solution by the transporting device 3.

After the plating of the substrate W, the liquid removing process described with reference to the flowchart of FIG. 9 or 10 may be performed.

The liquid removing apparatus 100 shown in FIGS. 5 and 6 can also be used as a leak check apparatus for inspecting sealing states of the first seal 48 and the second seal 47. The inspection of the sealing states of the first seal 48 and the second seal 47 is performed by enclosing a gas having a pressure higher than the atmospheric pressure in the internal space R, and checking whether the gas leaks from the internal space R through the first seal 48 and the second seal 47. The leak check is performed in a state where the substrate holder 24 holds the substrate W. If the first seal 48 and the second seal 47 do not properly exhibit their sealing function, the gas leaks from the internal space R to the atmosphere, and a pressure in the internal space R changes. The leak check is performed by detecting the pressure change in the internal space R.

The leak check is performed as follows. As shown in FIG. 6, the first seal 48 and the second seal 47 are brought into contact with the substrate W and the first holding member 38, respectively, to form the internal space R. The operation controller 109 instructs the on-off valve 128 to open to thereby supply the gas into the internal space R, until the internal space R is filled with the gas having a pressure higher than the atmospheric pressure. The operation controller 109 closes the on-off valve 128 and monitors a pressure measurement value transmitted from the pressure measuring device 117. The pressure measurement value shows the pressure of the gas in the gas supply line 114. Since the gas supply line 114 is in fluid communication with the internal space R, the pressure measurement value transmitted from the pressure measuring device 117 represents the pressure in the internal space R.

The operation controller 109 determines whether an amount of decrease in the pressure measurement value transmitted from the pressure measuring device 117 (i.e., an amount of decrease in the pressure in the internal space R) during a predetermined monitoring time exceeds a predetermined threshold value. If the amount of decrease in the pressure measurement value (i.e., the amount of decrease in the pressure in the internal space R) during the predetermined monitoring time exceeds the predetermined threshold value, the operation controller 109 determines that the sealing state of the first seal 48 and/or the second seal 47 is lowered. In that case, the substrate holder 24 is collected, and plating of the substrate W is not performed.

On the other hand, if the amount of decrease in the pressure measurement value (i.e., the amount of decrease in the pressure in the internal space R) during the predetermined monitoring time is smaller than the predetermined threshold value, the operation controller 109 determines that the sealing states of the first seal 48 and the second seal 47 are good. In that case, plating of the substrate W is performed.

Figure 12:
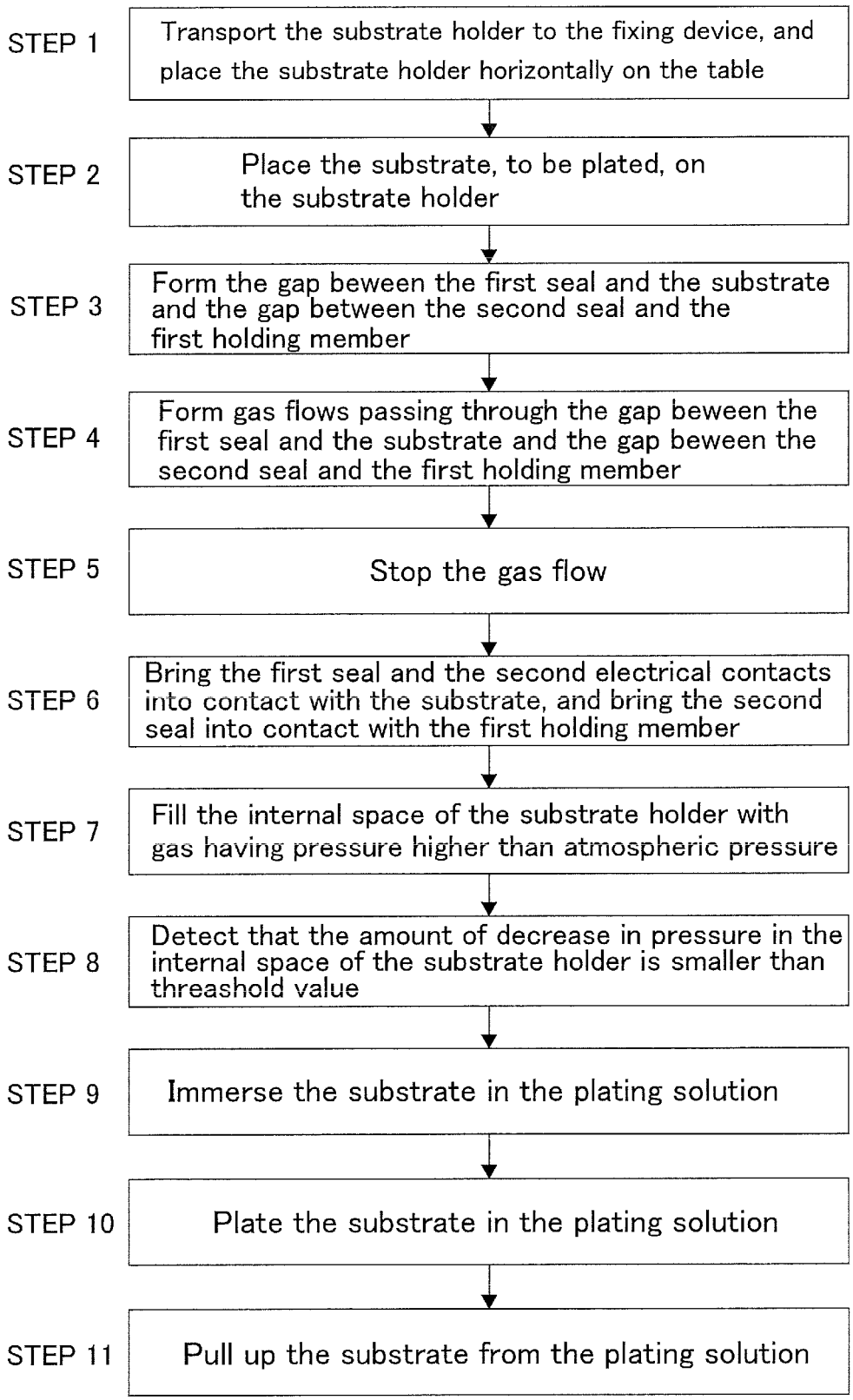
FIG. 12 is a flowchart illustrating one embodiment of removing a liquid from the first seal and the second seal using the liquid removing apparatus prior to plating of a substrate and then performing leak check of the first seal and the second seal.

FIG. 12 is a flowchart illustrating one embodiment of using the liquid removing apparatus 100 to remove the liquid from the first seal 48 and the second seal 48 and to perform the leak check of the first seal 48 and the second seal 47 prior to plating of the substrate W.

Step 1 to step 6 are the same as the step 1 to the step 6 shown in FIG. 11, and therefore repetitive descriptions will be omitted.

In step 7, the internal space R is filled with a gas having a pressure higher than the atmospheric pressure.

In step 8, the operation controller 109 detects that the amount of decrease in pressure of the gas in the internal space R during the predetermined monitoring time is smaller than the predetermined threshold value. This step 8 is a step of confirming that the first seal 48 and the second seal 47 are functioning properly.

In step 9, the substrate holder 24, holding the substrate W to be plated, is transported by the transporting device 3 to the plating tank 1, and the substrate W is immersed in the plating solution.

In step 10, a voltage is applied between the substrate W and the anode in the presence of the plating solution to plate the substrate W.

In step 11, the plated substrate W is pulled up from the plating solution by the transporting device 3.

After the plating of the substrate W, the liquid removing process described with reference to the flowchart of FIG. 9 or 10 may be further performed.

The substrate W in each of the embodiments described above is a circular substrate, such as a wafer, but the present invention can also be applied to a quadrilateral substrate. Each component of the substrate holder 24 for holding a quadrilateral substrate has a shape that conforms to the shape of such a substrate. For example, the opening 40*a* described above is a quadrilateral opening smaller than the size of the entire quadrilateral substrate. Various seal elements, such as the second seal 47 and the first seal 48, are also shaped to conform to the shape of the quadrilateral substrate. The shapes of the other structural members are also appropriately changed without departing from the above-described technical concept.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A method of plating a substrate with use of a substrate holder, comprising:

immersing the substrate in a plating solution, with a seal and an electrical contact of the substrate holder in contact with the substrate;

applying a voltage between the substrate and an anode in the plating solution to plate the substrate;

pulling up the plated substrate from the plating solution;

separating the seal from the plated substrate; and forming a flow of gas passing through a gap between the plated substrate and the seal, the flow of gas being directed from an inside to an outside of the substrate holder.

2. The method according to claim 1, wherein forming the flow of gas passing through the gap comprises forming the flow of gas passing through the gap while keeping the gap within a predetermined range.

3. The method according to claim 2, wherein forming the flow of gas passing through the gap comprises forming the flow of gas passing through the gap while keeping the gap constant.

4. The method according to claim 1, wherein separating the seal from the plated substrate comprises separating the seal from the plated substrate when an internal space of the substrate is filled with the gas having a pressure higher than an atmospheric pressure, the internal space being formed by the seal in contact with the plated substrate.

5. A method of plating a substrate with use of a substrate holder, comprising:

forming a flow of gas passing through a gap between the substrate to be plated and a seal of the substrate holder, the flow of gas being directed from an inside to an outside of the substrate holder;

immersing the substrate in a plating solution, with the seal and an electrical contact of the substrate holder in contact with the substrate; and applying a voltage between the substrate and an anode in the plating solution to plate the substrate.

6. The method according to claim 5, wherein forming the flow of gas passing through the gap comprises forming the flow of gas passing through the gap while keeping the gap within a predetermined range.

7. The method according to claim 6, wherein forming the flow of gas passing through the gap comprises forming the flow of gas passing through the gap while keeping the gap constant.

8. The method according to claim 5, further comprising:

bringing the seal into contact with the substrate to form an internal space in the substrate holder after the flow of gas through the gas is formed;

filling the internal space with a gas having a pressure higher than an atmospheric pressure; and detecting that an amount of decrease in pressure of the gas in the internal space during a predetermined monitoring time is smaller than a predetermined threshold value.

* * * * *